US007119643B2

(12) United States Patent
Iwasaki

(10) Patent No.: US 7,119,643 B2
(45) Date of Patent: Oct. 10, 2006

(54) REED RELAY HAVING CONDUCTIVE BUSHING AND OFFSET CURRENT CANCELING METHOD THEREWITH

(75) Inventor: Yukoh Iwasaki, Tokyo (JP)

(73) Assignee: Agilent Technologies, Inc., Palo Alto, CA (US)

( * ) Notice: Subject to any disclaimer, the term of this patent is extended or adjusted under 35 U.S.C. 154(b) by 24 days.

(21) Appl. No.: 10/886,252

(22) Filed: Jul. 7, 2004

(65) Prior Publication Data

US 2005/0088264 A1 Apr. 28, 2005

(30) Foreign Application Priority Data

Oct. 27, 2003 (JP) ..... 2003-366031

(51) Int. Cl.
*H01H 1/66* (2006.01)

(52) U.S. Cl. ..... 335/151; 335/154

(58) Field of Classification Search ..... 335/151–154
See application file for complete search history.

(56) References Cited

U.S. PATENT DOCUMENTS 5,963,116 A * 10/1999 Endoh et al. ..... 335/151
6,271,740 B1 * 8/2001 Chikamatsu ..... 335/151
6,683,518 B1 * 1/2004 Motta ..... 335/151
2005/0190028 A1 * 9/2005 Shimizu et al. ..... 335/151

FOREIGN PATENT DOCUMENTS

| | | |
|---|---|---|
| JP | 02-068829 | 3/1990 |
| JP | 08-279314 | 10/1996 |
| JP | 2001-014994 | 1/2001 |

* cited by examiner

*Primary Examiner*—Kyung S. Lee
*Assistant Examiner*—Bernard Rojas

(57) ABSTRACT

The heat-induced current that flows from the bushing on the outside into the electrostatic shield tube is recirculated to the conductive bushing by dividing the bushings into inside and outside insulating bushings in a concentric circle and a conductive bushing sandwiched by these insulating bushings with respect to the heat-induced current that flows as a result of the heat that has been transmitted from the coil bobbin to the electrostatic shield tube, and connecting the electrostatic shield tube and conductive bushing with a separate conductive member.

13 Claims, 5 Drawing Sheets

REED RELAY HAVING CONDUCTIVE BUSHING AND OFFSET CURRENT CANCELING METHOD THEREWITH

BACKGROUND OF THE INVENTION

When measuring microcurrent, it is necessary to primarily prevent leakage current from the pattern or the strip line on the measurement path, as well as leakage current from the relay on the measurement path. The reed relay cited in Japanese Patent (Kokai) 2001-14994 that uses a coil bobbin structure with which offset current attributed to heat-induced current and flowing to the reed relay is interrupted and that can be used for measurements on the order of femtoamperes (fA; $10^{-15}$ A) is a reed relay for microcurrent. The reed relay in FIG. 5 of JP (Kokai) 2001-14994 is shown in FIG. 6 of the present Specification. The structure of this reed relay will be described. A reed switch 501 is held inside electrostatic shield tube 503 by bushings 502*a* and 502*b*, which are made from a strong insulating material, and this electrostatic shield tube 503 is placed in the hollow cylinder part of coil bobbin 504. The area of contact between coil bobbin 504 and electrostatic shield tube 503 is such that space 509 is formed between the inside wall of coil bobbin 504 and the outside wall of electrostatic shield tube 503 by making projections 508*a* and 508*b* at the open ends of the hollow part of coil bobbin 504. Thus, joule heat that has been generated by coil 505 that is coiled around coil bobbin 504, virtually is not transmitted to electrostatic shield tube 503. As a result, it is possible to reduce the offset current that flows between relay terminals 517*a* and 517*b* and the respective bushings 502*a* and 502*b*, while, in the conventional type of the reed relays, the heat induced current is passed between bushings 502*a* and 502*b* and electrostatic shield tube 503 by transmitting joule heat to bushing 502*a* and 502*b*.

Nevertheless, developments in measurement technology have led to a need for a reed relay with which the measurement of even smaller currents is possible.

Japanese Patent No. (Kokai) 8[1996]-279314 relating to dielectric absorption of bushings and Japanese Patent (Kokai) 2[1990]-68829 relating to leakage current and thermoelectromotive force are other technologies for reed relays for microcurrent.

The present invention provides a reed relay with which offset current in microcurrent measurement is further reduced. The present invention also provides a reed relay which reduces the offset current flowing between the reed switch and bushing that is attributed to heat-induced current blowing between the bushing and the electrostatic shield tube. Still the present invention provides a structure with which charge transfer from heat-induced current from the bushing to the electrostatic shield tube in a reed relay is canceled.

SUMMARY OF THE INVENTION

A reed relay according to the present invention having a conductive bushing, wherein the reed relay comprises a reed switch, an electrostatic shield tube through which this reed switch passes, a support member that supports this reed switch inside this electrostatic shield tube, and a coil bobbin having a hollow part in which this electrostatic shield tube is placed and a coiled part; wherein this support member comprises a first insulating member contacting this reed switch, a second insulating member contacting this electrostatic shield tube, and a first conductive member sandwiched between this first insulating member and this second insulating member, and has a second conductive member to which this first conductive member and this electrostatic shield tube are connected.

The reed relay of the present invention may also adopt an embodiment wherein this first insulating member and this second insulating member and this first conductive member form concentric rings, with the inside periphery of the first conductive member contacting the outside periphery of the first insulating member and the inside periphery of the second insulating member contacting the outside periphery of the first conductive member, or an embodiment characterized in that this second conductive member is thin enough that the heat that is conducted through this second conductive member to this first conductive member can be restricted to a pre-determined amount.

The reed relay of the present invention may further adopt an embodiment wherein this second conductive member is a lead wire soldered to this first conductive member and this electromagnetic shield tube; an embodiment wherein this first conductive member is wider than the inner periphery of this second insulating member and this second conductive member connects with the side of this first conductive member; an embodiment wherein this second conductive member is a lead wire sandwiched between this electrostatic shield tube and the inner periphery of this first insulating member; an embodiment wherein this second conductive member is a conductive paint, conductive seal, or conductive plating applied to the surface of this second insulating member; or an embodiment characterized in that this conductive paint contains carbon or metal powder.

The reed relay of the present invention further comprises an embodiment wherein this coil bobbin comprises means for interfering with heat transmission that also has the function of supporting this electrostatic shield tube; an embodiment characterized in that this means for interfering with heat transmission is a circular projection at the end in the lengthwise direction of the hollow part of this coil bobbin; and an embodiment wherein one support member is present at each end of this electrostatic shield tube.

The principal characteristic of the method of the present invention is that it is an offset current canceling method for canceling the offset current in a reed relay having a reed switch, an electrostatic shield tube through which this reed switch passes, a support member that supports this reed switch inside this electrostatic shield tube, and a coil bobbin having a hollow part in which this electrostatic shield tube is placed and a coiled part; comprising a step wherein heat-induced current is passed to the contact part between this electrostatic shield tube and this support member by the heat transmitted from this electrostatic shield tube to this support member; a step wherein the current that has flowed out from this support member is replenished with current from the first conductive member of the ring that intersects between the first surface and the second surface of this support member; and a step wherein current is recirculated from this electrostatic shield tube to this first conductive member through the second conductive member that is connected with this first conductive member and this electrostatic shield tube.

DETAILED DESCRIPTION OF THE PREFERRED EMBODIMENT

According to the reed relay of the present invention, the heat-induced current that flows from the bushing on the outside into the electrostatic sealed tube with heat is recirculated to the conductive bushing by dividing the bushings into inside and outside insulating bushings in a concentric circle and a conductive bushing sandwiched by these insulating bushings with respect to the heat-induced current that flows as a result of the heat that has been transmitted from the coil bobbin to the electrostatic shield tube, and connecting the electrostatic shield tube and conductive bushing with a separate conductive member. Therefore, there is an advantage in that the offset current that flows from the relay terminal to the inside insulating bushing can be reduced even further.

Figure 1:
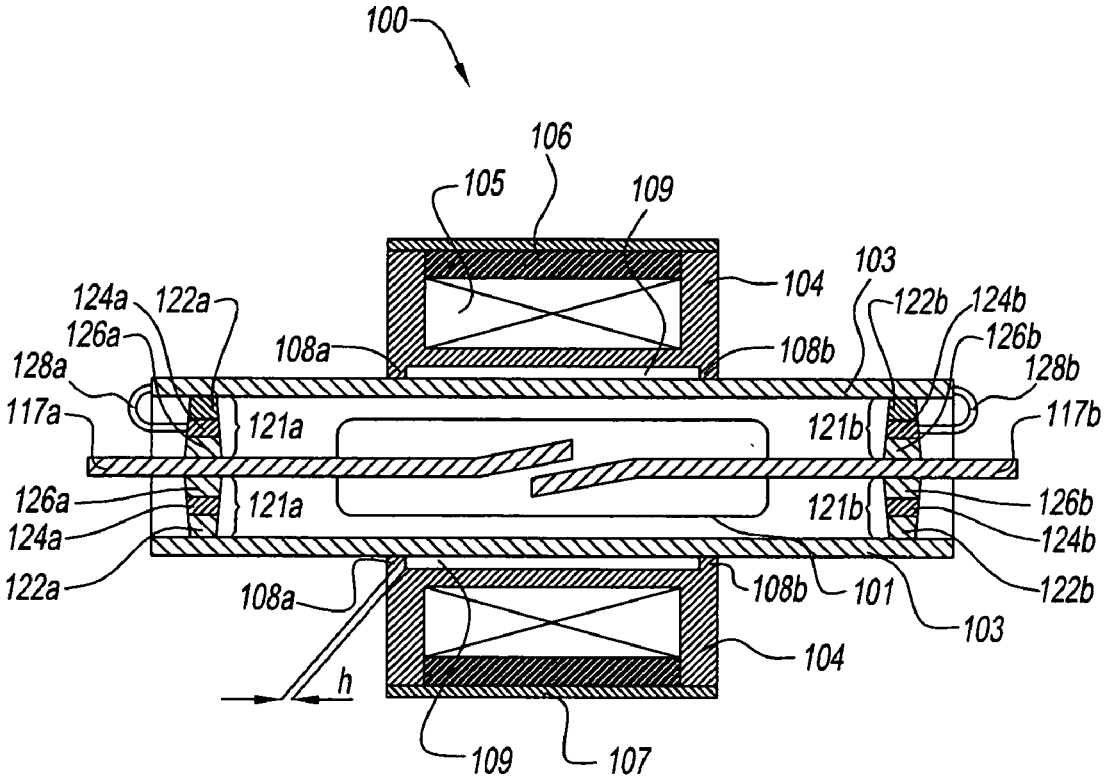
FIG. 1 is a cross section showing the structure of a reed relay of the present invention (Working Example 1).

According to the present invention, an annular first conductive member is placed inside a bushing and further, this conductive member and an electrostatic shield tube are connected by a second conductive member with poor heat conductivity, but good electrical conductivity, such as a lead wire, so that a return path for current is made between the electrostatic shield tube and the bushing and a closed circuit is formed between the electrostatic shield tube and conductive member in order to prevent the heat-induced current that is generated by the joule heat of the coil transmitted from the electrostatic shield tube to the bushing from inducing offset current from the relay terminals. Consequently, charge transfer confined to within this closed circuit and charge transfer between the relay terminals and bushing can be avoided. FIG. 1 shows the preferred embodiment of the reed relay of the present invention, and this is described below as the first embodiment.

A reed relay 100 of the first embodiment of the reed relay of the present invention shown in FIG. 1 is a reed relay comprising an electrostatic shield tube 103 housing a reed switch 101. Reed switch 101 is mechanically supported inside electrostatic shield tube 103 near both ends inside the tube by two bushings 121*a* and 121*b*.

Figure 2:
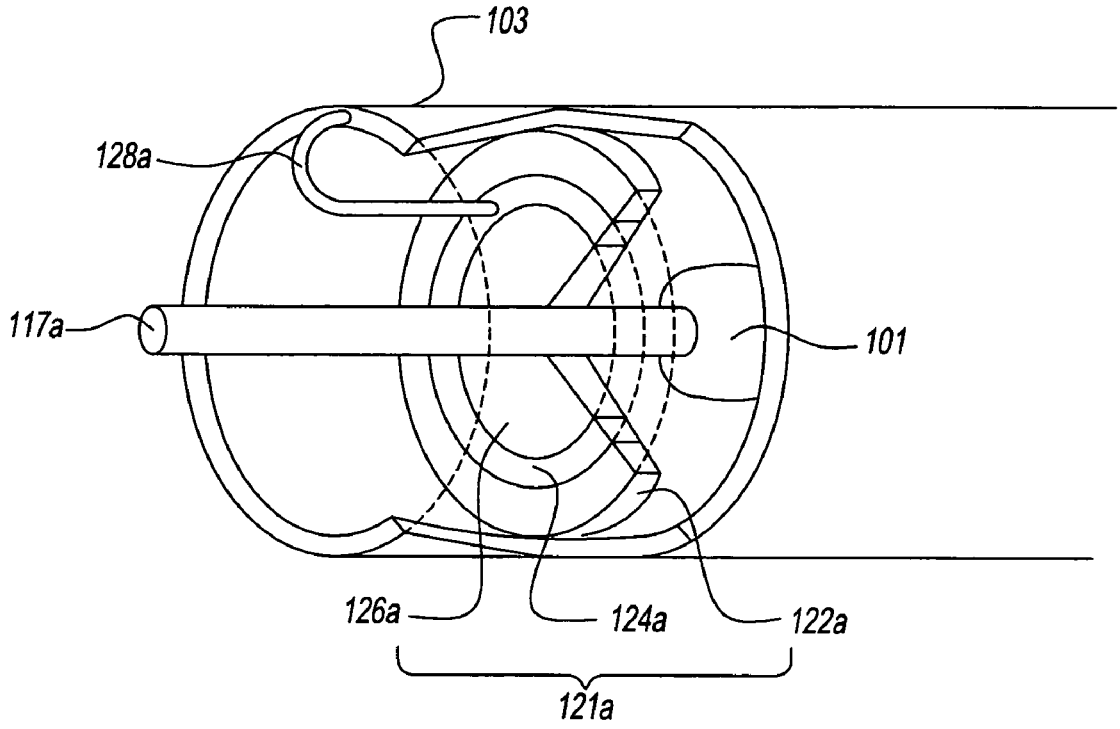
FIG. 2 is a structural diagram showing the structure near the bushing of the reed relay in FIG. 1.

In order to simplify the description, a drawing that describes the structure of the main structural parts of bushing 121*a* and electrostatic shield tube 103 of the present invention is shown in FIG. 2. Bushing 121*a* of the present invention comprises, facing the outside periphery from the part that contacts a relay terminal 117*a* of reed switch 101 and in a concentric circle, the annular members of a first insulating bushing 126*a*, a conductive bushing 124*a*, and a second insulating bushing 122*a*. The outside periphery of second insulating bushing 122*a* adjoins the electrostatic shield tube 103. In other words, conductive bushing 124*a* is sandwiched annularly between first and second insulating bushings 126*a* and 122*a*, and there is no place where first and second insulating bushings 126*a* and 122*a* adjoin one another.

First and second insulating bushings 126*a* and 122*a* are made from materials with a very low electrical conductivity such as PTFE (polytetrafluoroethylene) or FEP (fluorinated ethylene propylene copolymer). Conductive bushing 124*a* is made from a material with a high electrical conductivity, for instance, a metal such as iron, carbon materials, or a conductive plastic. Conductive bushing 124*a* may also have a conductive paint applied to the insulating member surface or may have conductive plating applied to the insulating member surface. For instance, when bushing 121 a is produced, it is possible to cut a tube of conductive material to make the conductive bushing and combine this together with the first and second insulating bushings, or to assemble a unit using an adhesive or fusion by heat. Examples of conductive paints that can be used are Dotite made by Fujikura Limited (brand name; http://www.fkkasei.co.jp/japanese/business/product/dotite.pdf) and EMC Coatings made by Moritex Corporation (http://www.moritex.co.jp/zigyo/pdf/d/zigyo d027.pdf). This also applies to the description of the working examples of the present invention given hereafter.

The surface of conductive bushing 124*a* and the surface of electrostatic shield tube 103 are connected by a conductive connection member 128*a*, such as a lead wire. A member with good electrical conductivity but poor heat conductivity is used for this conductive connection member 128*a* in order to prevent the generation of heat-induced current between conductive bushing 124*a* and first insulating bushing 126*a*. A conductive member such as a thin metal lead wire is used. Ideally the conductive connection member is soldered, or it can be connected to the surface of conductive bushing 124*a* or the surface of electrostatic shield tube 103 with a conductive adhesive.

Electrostatic shield tube 103 is held inside the hollow cylinder of a coil bobbin 104 around which a coil 105 is coiled, as shown in FIG. 1. Ideally coil 105 is kept in a magnetic shield case 107 packed with resin 106.

Coil bobbin 104 comprises projections 108*a* and 108*b* of thickness h at both ends inside the hollow cylinder to mechanically support electrostatic shield tube 103 and form space 109 between the outside periphery of electrostatic shield tube 103 and the inside wall of coil bobbin 104 and prevent heat from being transmitted from coil bobbin 104 to electrostatic shield tube 103. For instance, the thickness h is 2 mm.

Figure 3:
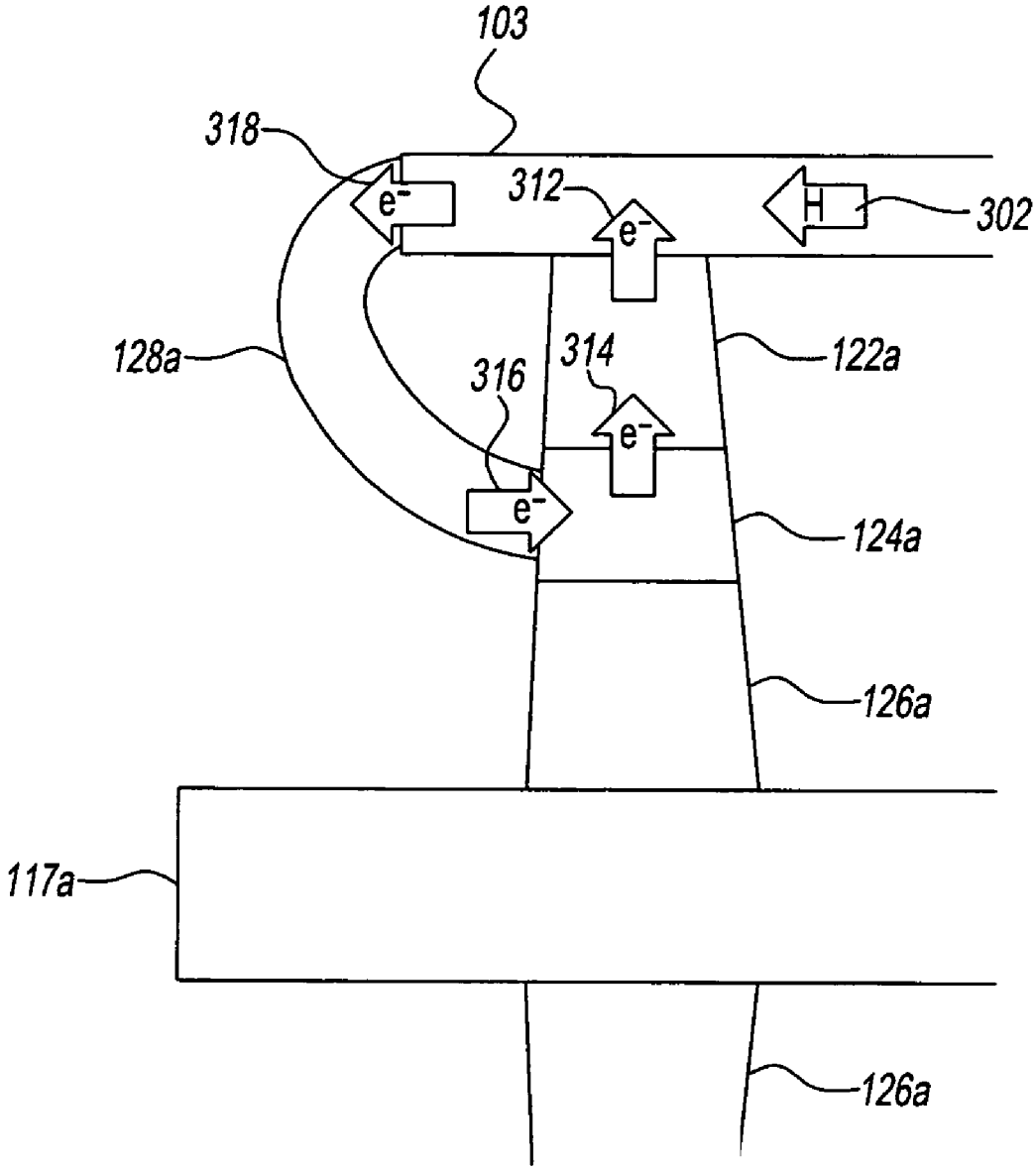
FIG. 3 is a schematic drawing showing charge transfer near the bushing of the reed relay in FIG. 1.

Next, for simplification, the effect of bushing 121*a*, electrostatic shield tube 103, and conductive connection member 128*a* will be described while referring only to these parts in FIG. 3. Charge transfer (arrow 312) occurs from second insulating bushing 122*a* to electrostatic shield tube 103 due to heat-induced current, which is created by the small amount of heat H (arrow 302) that has been transmitted from coil bobbin 104 to electrostatic shield tube 103. As a result, charge transfer (arrow 314) occurs from conductive bushing 124*a* to second insulating bushing 122*a* that now lacks charge. According to the prior art, there is no conductive connection member 128*a* or conductive bushing 124*a* and first and second insulating bushings 126*a* and 122*a* are made up into one unit. Therefore, charge transfer from relay terminal 117*a* occurs in order to compensate for the lack of charge at the insulating bushing members that form one unit and this becomes the offset current. However, according to the present invention, conductive connection member 128*a* that shows better charge transfer than the insulating members is connected to electrostatic shield tube 103 and therefore, charge transfer occurs from electrostatic shield tube 103 to conductive bushing 124*a* in order to compensate for the lack of charge at second insulating bushing 122*a*. That is, according to the present invention, a closed circuit is formed by the path of electrostatic shield tube 103-conductive connection member 128*a*-conductive bushing part 124*a*-electrostatic shield tube 103 and charge transfer is confined to this circuit. Therefore, charge transfer from relay terminal 117*a* to first insulating bushing 126*a* can be prevented.

Thus, it is possible to prevent offset current flowing to the reed switch by the present invention, even if heat-induced current is generated between the electrostatic shield tube and the bushing.

Moreover, conductive connection members 128*a* and 128*b* are connected to the end of electrostatic shield tube 103 and the end of conductive bushings 124*a* and 124*b*, respectively in FIG. 1, but the present invention is not limited to this connection method and the present invention implies that any part of the two members can be connected.

Furthermore, as long as there is heat conductivity from electrostatic shield tube 103, each of conductive connection members 128*a* and 128*b* can be provided as a plurality of conductive connection members for each of bushings 121*a* and 121*b*.

Figure 7:
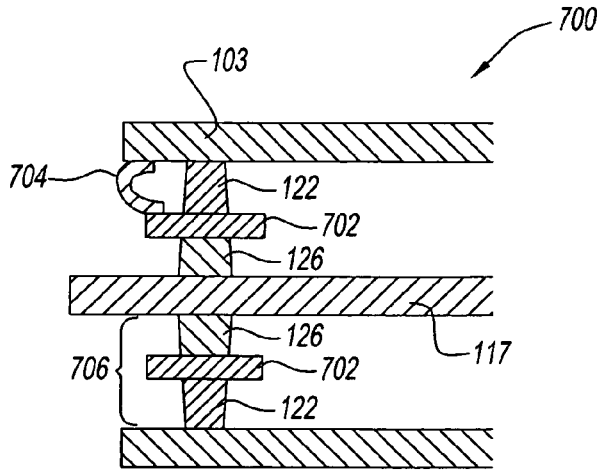
FIG. 7 is a cross section showing the structure near the bushing of the reed relay of the present invention (Working Example 2).

Next, a reed relay 700 of a second example of the present invention will be described while referring to FIG. 7. Reed relay 700 is the same as the relay in FIG. 1 with the exception of the region near a bushing 706. Therefore, only the region near this one bushing 706 is shown and the rest is omitted. Moreover, the members corresponding to FIG. 1 are represented by the same reference numbers, but the suffixes are omitted from FIG. 7 in order to simplify the description.

When compared to reed relay 100 in FIG. 1, reed relay 700 has a conductive bushing 702 that is made from a conductive material that is wider than the inner periphery of the second conductive bushing. Preferably, conductive bushing 702 is a metal tube, an insulating tube whose surface is coated with a conductive paint, or an insulating tube with a conductive plating. It should be noted here that the end of the conductive bushing protrudes from the surface of bushing 706 in the lengthwise direction of electrostatic shield tube 103, with conductive bushing 702 being attached to the first and second insulating bushings. Moreover, it is also possible for this conductive bushing 702 to protrude only at the open side of electrostatic shield tube 103.

A conductive connection member 704 that electrically connects electrostatic shield tube 103 and conductive bushing 702 is joined by soldering, using a conductive adhesive, or by fusing over the sides of both members or over the ends and the sides of both members. A member that has good electrical conductivity but poor heat conductivity is used for conductive connection member 704. A wire-shaped piece of a thin member such as a lead wire is used.

That is, according to the present working example, conductive connection member 704 is not necessarily connected to only the end of conductive bushing 702 and therefore a wider surface area can be used for the connecting procedure, simplifying the operation.

Figure 4:
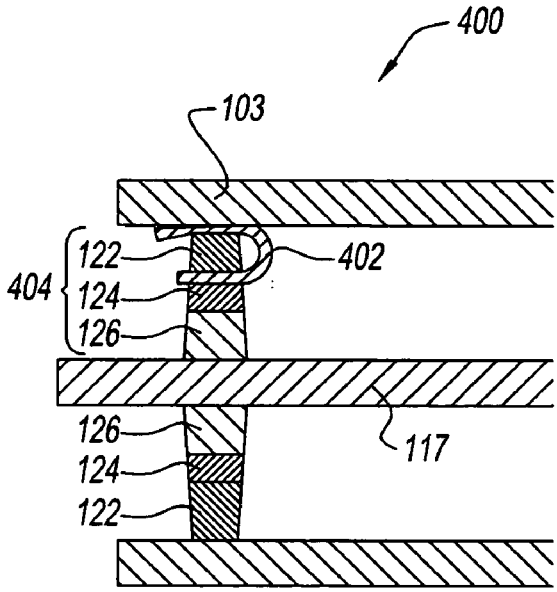
FIG. 4 is a cross section showing the structure near the bushing of the reed relay of the present invention (Working Example 3).

Next, a reed relay 400 of a third example of the present invention will be described while referring to the relay FIG. 4. Reed relay 400 in FIG. 4 is the same as the relay in FIG. 1 with the exception of the region near a bushing 404. Therefore, only the region near this one bushing, 404 is shown and the rest is omitted. Moreover, the members corresponding to FIG. 1 are represented by the same reference numbers, but the suffixes are omitted from FIG. 4 in order to simplify the description.

When compared to reed relay 100 in FIG. 1, a conductive connection member 402 of reed relay 400 that connects conductive bushing 124 and electrostatic shield tube 103 is connected by insertion and not by soldering. That is, conductive connection member 402 is assembled by sandwiching one end in between second insulating bushing 122 and conductive bushing 124, then bushing 404 that has just been assembled is inserted into electrostatic shield tube 103 so that the other end of conductive connection member 402 is sandwiched between the outside periphery of second conductive bushing 122 and the inside wall of electrostatic shield tube 103, and the remainder of conductive connection member 402 that is left protruding out is cut off. A member that has good electrical conductivity but poor heat conductivity is used for conductive connection member 402. A wire-shaped piece of a thin member such as a lead wire is used.

Thus, the time it takes to solder conductive connection member 128 in FIG. 1 can be saved.

Figure 5:
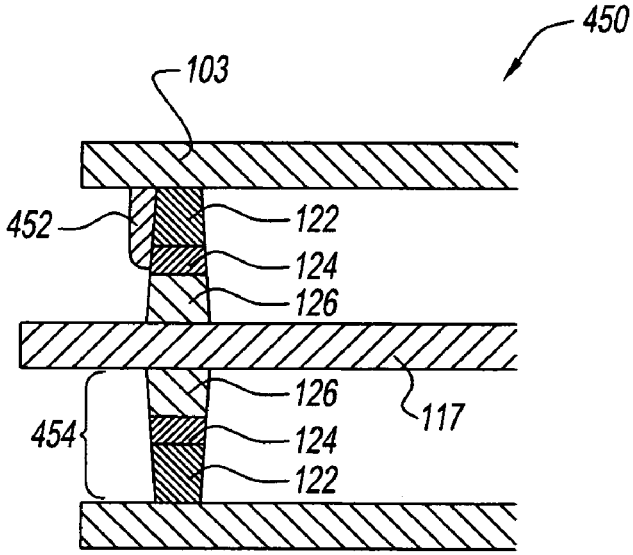
FIG. 5 is a cross section showing the structure near the bushing of the reed relay of the present invention (Working Example 4).
Figure 6:
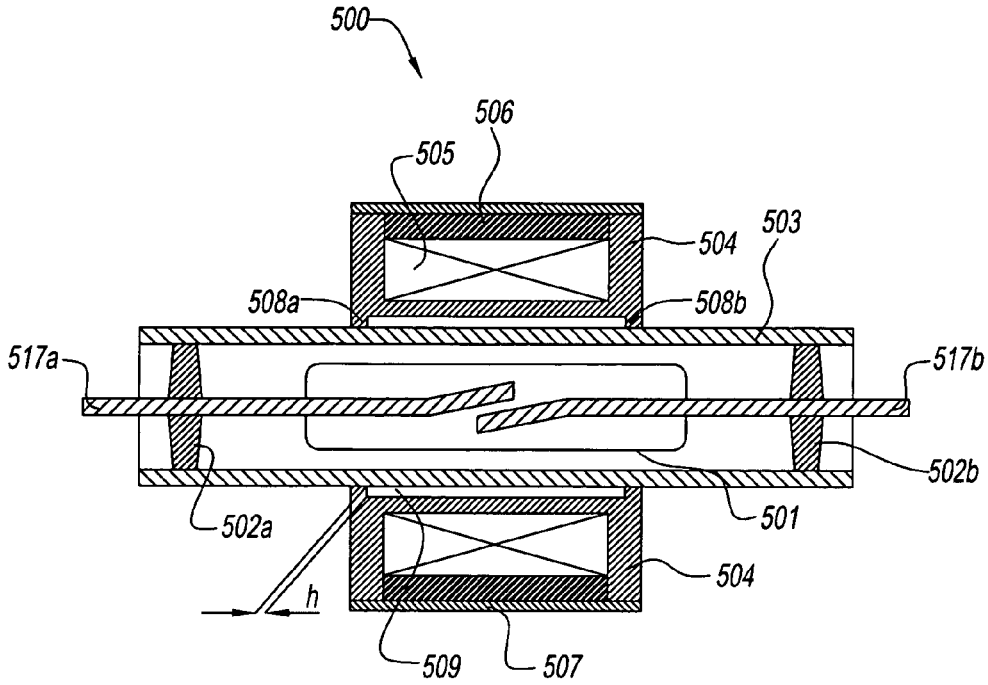
FIG. 6 is a cross section showing the structure of a conventional reed relay.

Next, a reed relay 450 of a fourth example of the present invention will be described while referring to FIG. 5. Reed relay 450 in FIG. 5 is the same as the relay in FIG. 1 with the exception of the region near a bushing 454. Therefore, only the region near this one bushing 454 is shown and the rest is omitted. Moreover, the members corresponding to FIG. 1 are represented by the same reference numbers, but the suffixes are omitted from FIG. 5 in order to simplify the description.

Reed relay 450 does not use conductive connection member 128 of reed relay 100 in FIG. 1. It uses conductive paint or conductive plating as a conductive connection member 452. That is, when conductive paint is used as conductive connection member 452, a conductive paint containing carbon or metal powder is applied between conductive bushing 124 and electrostatic shield tube 103 once bushing 454 has been inserted into electrostatic shield tube 103. Moreover, when conductive plating is used as conductive connection member 452, the plating is pre-applied over the outside of conductive bushing 124 and second insulating bushing 122 of bushing 454 and then bushing 454 is inserted into electrostatic shield tube 103. It should be noted that when conductive paint is applied or conductive plating is performed, it is necessary to take into consideration heat conduction from electrostatic shield tube 103 and in accordance with this heat conduction, consider applying the conductive paint or plating in a long, thin pattern or in a thin layer, and in one application or multiple applications. In addition, conductive seal is used as the conductive paint. A member that has good electrical conductivity but poor heat conductivity is used for conductive connection member 452. A wire-shaped piece of a thin member such as a lead wire is used.

Thus, the time it takes to connect electrostatic shield tube 103 and conductive bushing 124 can be reduced.

A reed relay that controls offset current produced by heat-induced current was described with emphasis on the bushings. The coil bobbin described in the present invention has projections 108 and these prevent transmission of heat to the electrostatic shield tube. However, a variety of conventional technologies can be used for the coil bobbin. For instance, projections 108 are not limited to one ring. There can be multiple projections, and these projections can have a variety of shapes. Moreover, it is possible to use a heat sink or Peltier element in place of projections 108 of the coil bobbin, or in combination with the projection of the coil bobbin.

The present invention can be used not only with a single reed relay where only one reed switch is housed inside a case, but also in a reed relay where two or more reed switches are housed in the case. Moreover, when the reed relay is one in which multiple reed switches are housed, all of the reed switches can be simultaneously operated to either make or break the circuit, or some can be operated to make the circuit and the others can be operated to break the circuit.

What is claimed is:

1. A reed relay having a conductive bushing, said reed relay comprising:

a reed switch, an electrostatic shield tube through which said reed switch passes, a support member that supports said reed switch inside said electrostatic shield tube, comprising:

a first insulating member contacting said reed switch, a second insulating member contacting said electrostatic shield tube, and a first conductive member sandwiched between said first insulating member and said second insulating member;

a coil bobbin having a hollow part in which said electrostatic shield tube is placed and a coiled part; and a second conductive member connected to said first conductive member and said electrostatic shield tube.

2. The reed relay according to claim 1, wherein said first insulating member, said second insulating member and said first conductive member form concentric rings, with the inside periphery of the first conductive member contacting the outside periphery of the first insulating member and the inside periphery of the second insulating member contacting the outside periphery of the first conductive member.

3. The reed relay according to claim 1, wherein said second conductive member has poor heat conductivity and good electrical conductivity.

4. The reed relay according to claim 1, wherein said second conductive member is a lead wire soldered to said first conductive member and said electromagnetic shield tube.

5. The reed relay according to claim 1, wherein said first conductive member is wider than the inner periphery of said second insulating member, and said second conductive member connects with the side of said first conductive member.

6. The reed relay according to claim 1, wherein said second conductive member is a lead wire sandwiched between said electrostatic shield tube and the inner periphery of said first insulating member.

7. The reed relay according to claim 1, wherein said second conductive member is a conductive paint, conductive seal, or conductive plating applied to the surface of said second insulating member.

8. The reed relay according to claim 7, wherein said conductive paint contains carbon or metallic powder.

9. The reed relay according to claim 1, wherein said coil bobbin comprises a component that interferes with heat transmission that also has the function of supporting said electrostatic shield tube.

10. The reed relay according to claim 9, wherein said component that interferes with heat transmission is a circular projection at the end in the lengthwise direction of the hollow part of said coil bobbin.

11. The reed relay according to claim 1, wherein one of said support members is found at each end of said electrostatic shield tube.

12. A method for canceling the offset current in a reed relay comprising: a reed switch, an electrostatic shield tube through which said reed switch passes, a support member that supports said reed switch inside said electrostatic shield tube, and a coil bobbin having a hollow part in which said electrostatic shield tube is placed and a coiled part, wherein said method comprises:

passing a heat-induced current, through a contact part between said electrostatic shield tube and said support member by heat transmitted from said electrostatic shield tube to said support member;

replenishing the current that has flowed out from said support member with current from a first conductive member of the support member that intersects between a first surface and a second surface of said support member; and recirculating current from said electrostatic shield tube to said first conductive member through a second conductive member that is connected to said first conductive member and said electrostatic shield tube.

13. The reed relay according to claim 5, wherein said second conductive member is a lead wire soldered to said first conductive member and said electromagnetic shield tube.

* * * * *